US007531027B2

(12) United States Patent
Tepper et al.

(10) Patent No.: US 7,531,027 B2
(45) Date of Patent: May 12, 2009

(54) CONTAMINANT EXTRACTION SYSTEMS, METHODS, AND APPARATUSES

(75) Inventors: Gary C. Tepper, Glen Allen, VA (US); Royal Kessick, Richmond, VA (US); Dmitry Pestov, Glen Alen, VA (US)

(73) Assignee: Sentor Technologies, Inc., Glen Allen, VA (US)

( * ) Notice: Subject to any disclaimer, the term of this patent is extended or adjusted under 35 U.S.C. 154(b) by 0 days.

(21) Appl. No.: 11/751,000

(22) Filed: May 18, 2007

(65) Prior Publication Data

US 2008/0121106 A1 May 29, 2008

Related U.S. Application Data

(60) Provisional application No. 60/747,663, filed on May 18, 2006, provisional application No. 60/747,664, filed on May 19, 2006.

(51) Int. Cl.
*B03C 3/014* (2006.01)

(52) U.S. Cl. ..... 96/27; 95/71; 96/53

(58) Field of Classification Search ..... 96/27, 96/52, 53; 95/64–66, 71, 72
See application file for complete search history.

(56) References Cited

U.S. PATENT DOCUMENTS

| | | | | | |
|---|---|---|---|---|---|
| 2,583,899 | A * | 1/1952 | Smith | 204/155 |
| 3,958,958 | A * | 5/1976 | Klugman et al. | 95/64 |
| 3,958,959 | A * | 5/1976 | Cohen et al. | 95/64 |
| 3,960,505 | A * | 6/1976 | Marks | 422/168 |
| 4,072,477 | A * | 2/1978 | Hanson et al. | 95/71 |
| 4,095,962 | A * | 6/1978 | Richards | 95/65 |
| 4,146,371 | A * | 3/1979 | Melcher et al. | 95/62 |
| 4,222,748 | A * | 9/1980 | Argo et al. | 95/64 |
| 4,624,763 | A * | 11/1986 | Chimenti | 204/562 |
| 5,624,476 | A * | 4/1997 | Eyraud | 95/65 |
| 6,156,098 | A * | 12/2000 | Richards | 95/65 |
| 6,471,753 | B1 * | 10/2002 | Ahn et al. | 96/27 |
| 6,607,579 | B2 * | 8/2003 | Willey et al. | 95/71 |
| 6,656,253 | B2 * | 12/2003 | Willey et al. | 96/27 |
| 7,160,391 | B2 * | 1/2007 | Willey et al. | 118/629 |
| 2003/0196552 | A1 * | 10/2003 | Willey et al. | 96/44 |
| 2004/0023411 | A1 * | 2/2004 | Fenn | 436/174 |
| 2006/0081178 | A1 * | 4/2006 | Willey et al. | 118/621 |
| 2006/0185511 | A1 * | 8/2006 | Tepper | 95/71 |

* cited by examiner

*Primary Examiner*—Richard L Chiesa
(74) *Attorney, Agent, or Firm*—Michael P. Eddy

(57) ABSTRACT

An improved system for removing particles and contaminants from an air flow attract particles and contaminants to a plurality of charged spray droplets. The system has a first channel with an inlet and an outlet into which a first air flow is directed, an air flow containing a plurality of contaminants, a solvent reservoir containing a volume of solvent, one or more charged droplet sources for producing a plurality of charged liquid droplets, a second channel with an inlet and an outlet into which a second air flow is directed, one or more voltage reduction electrodes positioned about at least one of said electrospray sources, a grounded counter electrode, and at least one grid positioned between the plane of the charged droplet source and the grounded counter electrode. The voltage between the grid electrode and the charged droplet source is sufficient to sustain an electrospray process. The electrostatic force at the one or more charged droplet sources is sufficient to overcome the surface tension of the solvent. The charged liquid droplets are dispersed into the first channel allowing the plurality of contaminants in the first air flow to become charged.

20 Claims, 5 Drawing Sheets

CONTAMINANT EXTRACTION SYSTEMS, METHODS, AND APPARATUSES

CROSS-REFERENCES TO RELATED APPLICATIONS

This application claims the benefit of U.S. provisional application Ser. No. 60/747,663, filed May 18, 2006, and U.S. provisional application Ser. No. 60/747,664, filed May 19, 2006 which are incorporated herein by reference in their entirety for all purposes.

STATEMENT REGARDING FEDERALLY SPONSORED RESEARCH OR DEVELOPMENT

None.

REFERENCE TO SEQUENCE LISTING, A TABLE, OR A COMPUTER PROGRAM LISTING COMPACT DISK APPENDIX

None.

BACKGROUND

1. Field

Embodiments of the claimed subject matter relate to methods, systems and apparatuses for purifying air, and more particularly, to systems, methods and apparatuses for removing particles and contaminants from an air flow by attracting the particles and contaminants to charged spray droplets of a fluid introduced to the air.

2. Description of the Related Art

The prior art describes many known uses of nozzle spray heads that are provided for use in dynamic electrostatic air filters. For example, U.S. Pat. No. 7,160,391 to Willey et al. describes a nozzle spray head that is provided for use in a dynamic electrostatic air filter, in which the nozzle spray head assembly exhibits multiple nozzle orifices as outlet ports, which extend from the bottom of the nozzle body such that the distances between the outlet ports and a target member are not constant. The charged multiple outlet ports exhibit a more uniform electric field at their tips, thereby enabling a better and more uniform spray pattern to be emitted by each of the individual outlet ports. In one embodiment, the outlet ports are grouped in concentric circles, in which the innermost circle comprises outlet ports of the greatest lengths, and the outermost circle comprises outlet ports of the smallest lengths. Each nozzle is aligned with a ring electrode that is used to produce the electric field.

U.S. Published Application Number 2006/0081178 to Willey et al. describes a nozzle spray head that is provided for use in a dynamic electrostatic air filter, in which the nozzle spray head assembly exhibits multiple nozzle orifices as outlet ports, which extend from the bottom of the nozzle body such that the distances between the outlet ports and a target member are not constant. The charged multiple outlet ports exhibit a more uniform electric field at their tips, thereby enabling a better and more uniform spray pattern to be emitted by each of the individual outlet ports. In one embodiment, the outlet ports are grouped in concentric circles, in which the innermost circle comprises outlet ports of the greatest lengths, and the outermost circle comprises outlet ports of the smallest lengths.

SUMMARY

The claimed subject matter relates to improved apparatuses, systems and methods for removing particles and contaminants from an air flow by attracting the particles and contaminants to charged spray droplets of a fluid introduced to the air. Potential benefits include of the voltage reduction embodiments include reduced propensity for unwanted electrical discharge or leakage, lower cost power supply circuits and reduced danger to users.

An improved system for removing particles and contaminants from an air flow attract particles and contaminants to a plurality of charged spray droplets. The system has a first channel with an inlet and an outlet into which a first air flow is directed, an air flow containing a plurality of contaminants, a solvent reservoir containing a volume of solvent, one or more charged droplet sources for producing a plurality of charged liquid droplets, a second channel with an inlet and an outlet into which a second air flow is directed, one or more voltage reduction electrodes positioned about at least one of said electrospray sources, a grounded counter electrode, and at least one grid positioned between the plane of the charged droplet source and the grounded counter electrode. The voltage between the grid electrode and the charged droplet source is sufficient to sustain an electrospray process. The electrostatic force at the one or more charged droplet sources is sufficient to overcome the surface tension of the solvent. The charged liquid droplets are dispersed into the first channel allowing the plurality of contaminants in the first air flow to become charged. The maximum air velocity in the channel is below the velocity at which charged contaminants would be carried through the air purification system without being transported through said grid electrode and into the second air stream and the grid electrode extracts the charged contaminants from the first air flow after which the charged contaminants are transferred into the second air flow.

BRIEF DESCRIPTION OF THE DRAWINGS

The accompanying drawings, which are incorporated in and constitute a part of this specification, illustrate embodiments of the claimed subject matter, and, together with the description, further explain the claimed subject matter. In the drawings.

DETAILED DESCRIPTION OF THE EMBODIMENTS

Figure 1:
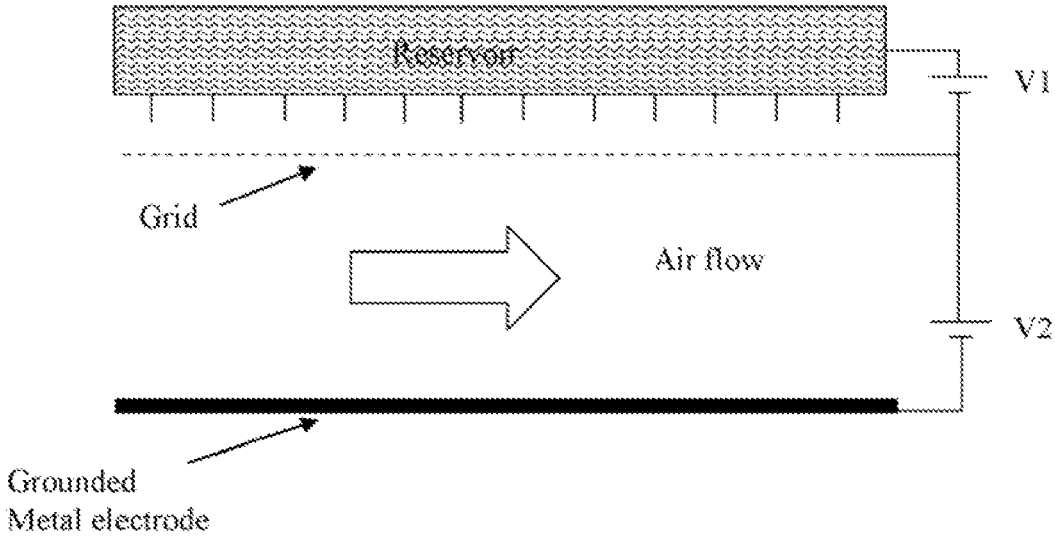
FIG. 1 is a schematic diagram illustrating an embodiment utilizing a grid electrode to reduce the total the voltage and/or power requirements of the embodiment.

In describing the inventive subject matter, including those embodiments illustrated in the drawings, specific terminology is employed for the sake of clarity. Although these parameters will now be discussed in further detail, these descriptions are not an exhaustive explanation of all possible variations in structure and operation. It will be apparent to those skilled in the art that various other changes or modifications can be made without departing from the spirit and scope of the embodiments presented herein. It should be further apparent that any or all combinations of the individual described variations with the disclosed embodiments are possible. U.S. patent Ser. No. 11/276,355 filed on 24 Feb. 2006 to Gary C. Tepper is incorporated by reference in its entirety herein.

Reference throughout this specification to "one embodiment" or "an embodiment" means that a particular feature, structure, or characteristic described in connection with the embodiment is included in at least one embodiment of the claimed subject matter. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

In embodiments of the claimed subject matter, a high voltage may be applied to the charged droplet source, such as a charged droplet source composed of an array of nylon wicks or capillary tubes, with respect to either a grounded counter electrode or with respect to a grid electrode placed between the one or more charged droplet source(s) and the grounded electrode held at an intermediate potential.

In embodiments containing the intermediate grid electrode, the grid electrode extracts charged contaminants from one or more incoming air streams and the extracted contaminants are transferred into another air stream flowing in the opposite direction. In other embodiments, the second airstream may be made up of more than one airstream and it may be positioned perpendicularly or at any other angle in relation to the incoming one or more airstreams.

In these embodiments, the voltage between the grid electrode and the charged droplet sources is sufficient to sustain an electrospray process wherein the electrostatic force at the one or more electrospray sources, such as an array of wicks, is sufficient to overcome the surface tension of the solvent. Additionally, in this embodiment, the distance between the charged droplet sources and the grid electrode is large enough to provide an airflow channel, whereby the maximum air velocity in the channel is below the velocity at which charged contaminants would be carried through the air purification system without being transported through the grid electrode and into the second air stream.

Embodiments having an intermediate grid electrode can gain additional efficiency or functionality not found in other embodiments. For example, in one embodiment, if it is desired that the grid electrode is only to initiate and sustain the electrospray process, but not to simultaneously define an upper airflow channel, then the distance between the charged droplet sources and the grid electrode can be arbitrarily small. In this embodiment, because it is the electric field magnitude and not the voltage magnitude that initiates and sustains an electrospray process, reducing the source-to-grid distance proportionally reduces the source to grid voltage requirements.

In one example embodiment, if the required electric field magnitude necessary to sustain the electrospray process is 2 kV/cm, then this electric field can be achieved by applying a potential of 10 kV across a distance of 5 cm. In another example, an embodiment using a potential of 1 kV across a distance of 0.5 cm may be applied to achieve this electric field. FIG. 1 is a schematic diagram illustrating an embodiment utilizing a grid electrode to reduce the total voltage and/or power requirements of the embodiment. In this embodiment, the grid electrode consists of a mesh material with a high degree of optical transparency. Because of this mesh material, the charged droplets generated between the source and grid electrode are propelled past the grid electrode and into the single air flow channel located between the grid electrode and the grounded electrode as illustrated in FIG. 1.

In use, the electric field magnitude between the grid and ground electrode can be much smaller than the electric field magnitude between the source and the grid because it is not necessary to initiate or sustain an electrospray process in this second region. Rather, the electric field between the grid and the ground electrode maintains a finite force on the electrically charged droplets and on any electrically charged air contaminants so that said droplets and contaminants are transported toward the grounded counter electrode while the neutral purified air continues through the device unaffected. This finite electric force can be achieved, for example, by an electric field with a magnitude of less than 1 kV/cm, for example 500V/cm.

In one example embodiment, the distance between the source and grid is 0.5 cm and the distance between the grid and the ground electrodes is 5 cm, while the voltage between the source and the grid is 1 kV and the voltage between the grid and the ground is 2.5 kV. In this embodiment, the magnitude of the electric field between the source and the grid is 2 kV/cm which is sufficient to maintain the electrospray process. Also in this embodiment, the magnitude of the electric field between the grid and ground is 500V/cm which is sufficient to transport the charged species toward the grounded electrode. The total voltage required in this embodiment is 3 kV. By comparison, in a single channel device, or in a device that does not use a grid and which has a source to ground distance of 5 cm, a voltage of 10 kV would be necessary to produce an electric field magnitude of 2 kV/cm at the one or more charged droplet sources. In this example embodiment, the use of the grid as an electric field concentrator allows the required voltage (as well as the power to the device) to be reduced by more than a factor of three. Additionally, in this embodiment, the grid also functions to keep the charged droplet sources (such as a plurality of wicks) out of the contaminated air stream thereby preventing the deposition of air contaminants onto the surface of the sources leading to an increased operational lifetime of the embodiment components.

Figure 2A:
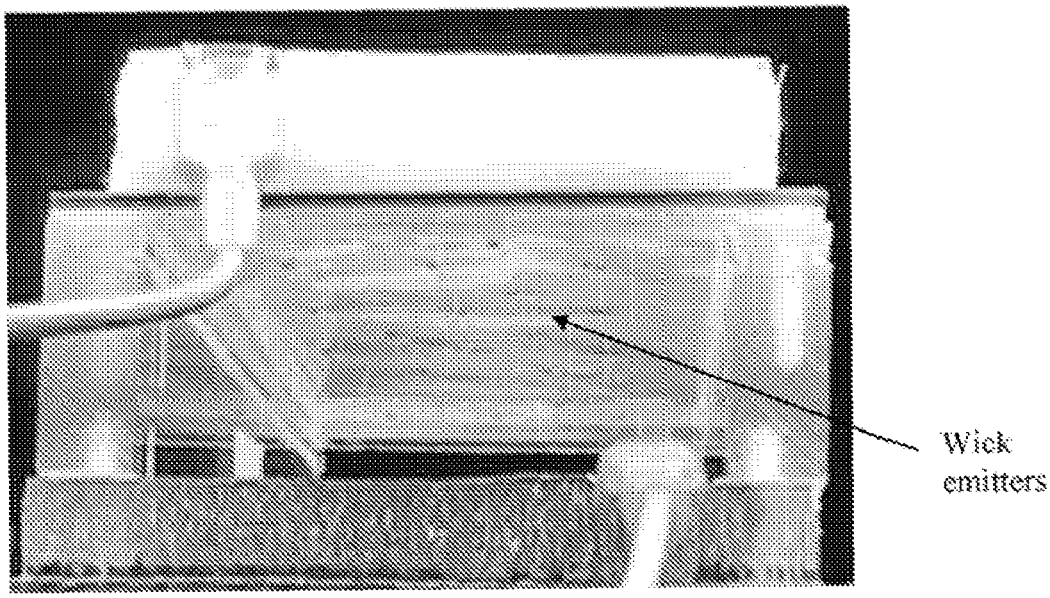
FIG. 2A shows a prototype embodiment constructed in the conventional geometry without an intermediate voltage reduction grid and with an operating voltage of 10 kV.
Figure 2B:
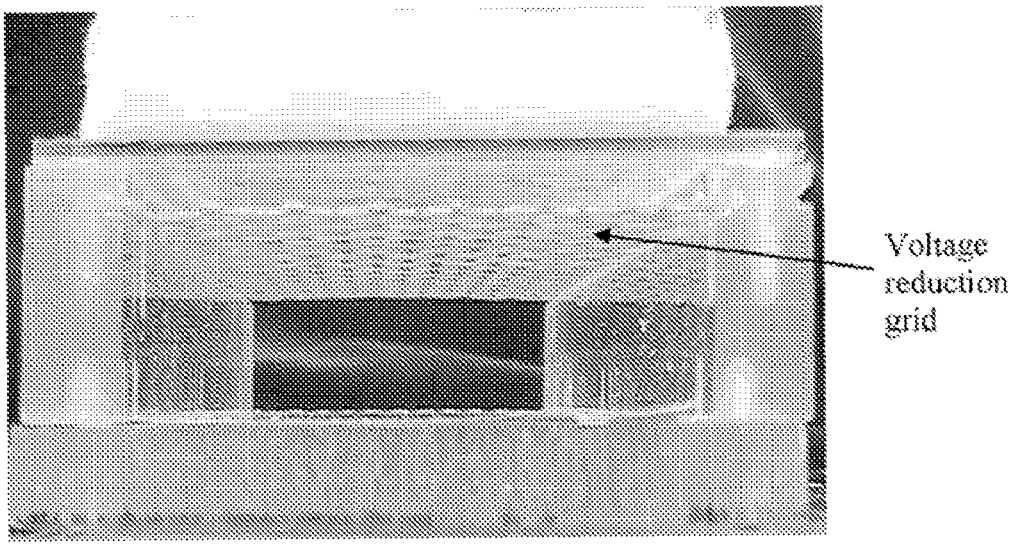
FIG. 2B shows another prototype embodiment having a voltage reduction grid with an operating voltage of 3 kV.
Figure 3:
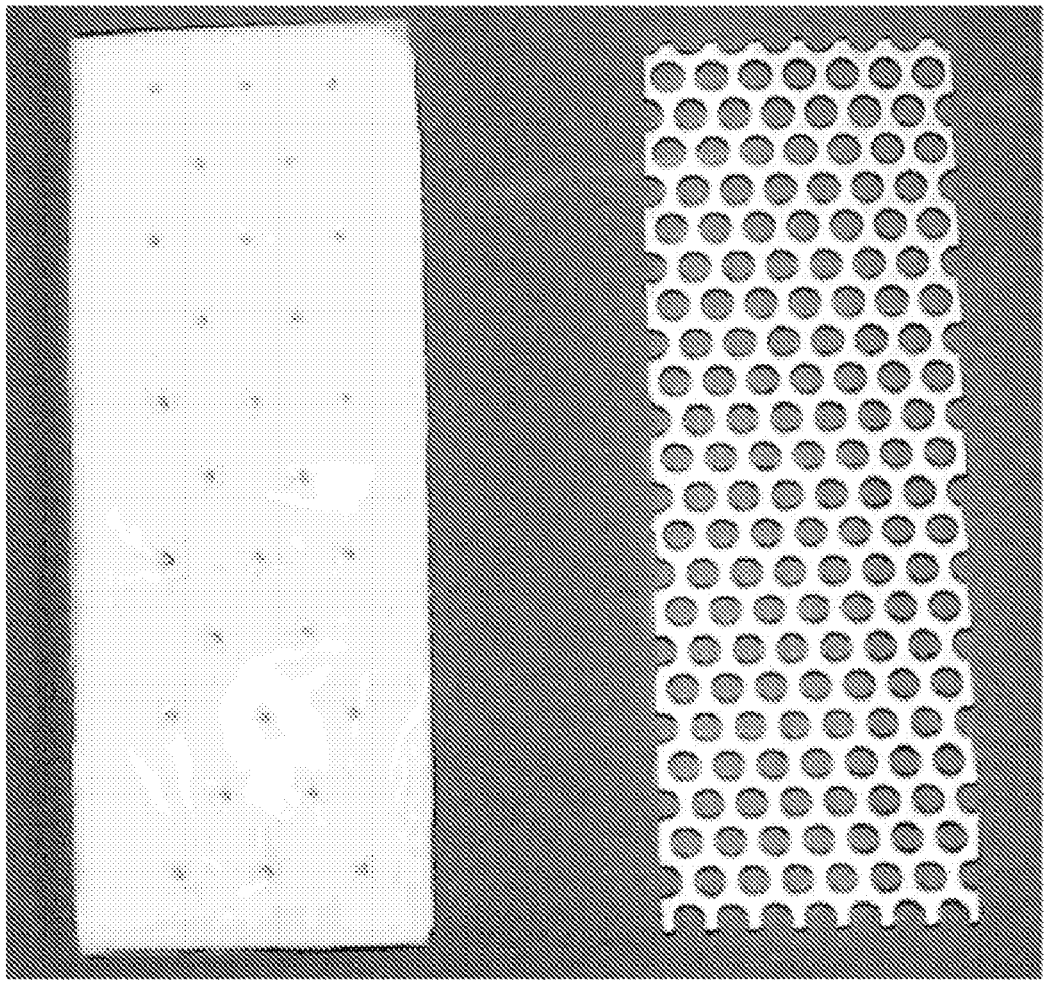
FIG. 3 is a photograph of the charged droplet emitter array the voltage reduction grid used in the second prototype embodiment as shown in FIG. 2B.

FIGS. 2A and 2B are illustrations of two small prototype charged droplet air purification embodiments which demonstrate the voltage/power reduction principle. FIG. 2A shows a prototype embodiment constructed in the conventional geometry without an intermediate voltage reduction grid and with an operating voltage of 10 kV. FIG. 2B shows another prototype embodiment having a voltage reduction grid with an operating voltage of 3 kV. FIG. 3 is a photograph of the charged droplet emitter array the voltage reduction grid used in the second prototype embodiment as shown in FIG. 2B. This embodiment includes a wick emitter array, water reservoir and voltage reduction grid.

In another embodiment, the openings in the grid and the tips of the electrospray sources are not arranged in a specific geometric correlation. For example, the openings in the grid and the tips of the electrospray sources are not in alignment. In other embodiments, the voltage between the grid and the electrospray source plane is maintained such that the electric field, the voltage divided by distance, is sufficient to produce an electrospray, for example in a range of ~2–4 kV/cm. In several other embodiments, the voltage between the grid and the grounded counter electrode does not need to be large enough to produce an electrospray. That is, the voltage used may of a value that is sufficient to move the charged species toward the grounded collecting electrode. In these exemplary embodiments, the overall voltage requirement can be reduced by a factor of two or three.

In other embodiments, the voltage reduction grid is constructed of geometries other than a planar geometry. For instance, in one embodiment, the voltage reduction grid has a cylindrical geometry wherein the voltage reduction grid is a cylinder coaxial with the central cylinder containing the electrospray (charged droplet) sources which protrude radially from the center cylinder. The grounded third electrode is coaxial to the two inner cylinders.

In another embodiment, wick-based electrospray sources are used instead of conventional capillary tubes for the charged droplet source. In another embodiment, the system with the voltage reduction grid uses a water and/or water plus alcohol based solution with or without an additional antibacterial component as the solvent. In another embodiment, the grid electrode also functions to isolate the electrospray sources from the main airflow channel thereby protecting them from dust and contamination and aiding in extending the useful lifetime of the system between cleanings. In this embodiment, the grid is constructed of an electrically conductive material such as a metal or metal alloy. Other embodiments may be constructed of a non corrosive metal or metal alloy such as stainless steel or aluminum.

In several embodiments, the diameters of the wires found in the grid electrode are just of a sufficient thickness to maintain the structural self supporting nature of the grid so that it does not flex or deform, for example so the grid does not sag or curve downwards. In embodiments wherein the diameters of the wires in the grid are not sufficiently large to allow the wires to support the grid structure, a support frame may be added to the grid for maintaining the structural integrity and placement of the grid.

In the previously described embodiments, the grid transparency should be high, for example >90% or similar to the transparency found in a screen door. In this way, the majority of charged droplets from the electrospray sources will pass freely through the grid without being blocked. In general, the wire diameter and transparency are optimized to achieve structural integrity of the grid as well as high transparency to the charged droplets. In contrast, if the grid is constructed to be too coarse in nature a smooth voltage plane will not be defined.

In other embodiments, the grid can be heated in any manner or by any commercially known means, for example resistively or with an external heat source such as a lamp. The heating of the grid can help in minimizing the formation of condensed water on the grid and it may facilitate the removal of any collected dust or debris located on the grid.

Other embodiments employ the use of changing polarity of AC potentials in order to improve the performance of the contaminant extraction system, methods and apparatus. In one embodiment, the changing polarity of the voltage source changes the charge polarity of the droplets such that alternating streams of positive and negative droplets are emitted.

Existing electrostatic air purifiers such as the "Ionic Breeze" systems sold by the Sharper Image and embodiments of the Sentor air purification system described in U.S. patent application Ser. No. 11/276,355 operate using a DC potential. In Sentor's embodiments, the DC potential is used to produce a stream of either positively or negatively charged aqueous liquid droplets through a parallel array of wick-fed electrospray sources. The polarity (whether positive or negative charge) on the liquid droplets matches the polarity of the DC potential. Air purification is accomplished by transferring some of the charge on the liquid droplets onto polar or polarizable air contaminants such as odors, smoke, bacteria, and particles through gas phase interactions and then the charged particles/contaminants are removed from the air stream using an electric field. In these embodiments, a fan is used to introduce contaminated air into the embodiments of the purification system and the air flow rate is typically carefully controlled and matched to the collection properties of the device.

In these examples, the charged contaminants are removed from the air stream and deposited onto the surface of an electrically conducting grounded counter electrode, which can consist of a metal plate or any other suitable substrate known to those skilled in the art. The collected charged contaminants are neutralized as they encounter the metal electrode and the charge flows to ground and completes the electric circuit.

Figure 4:
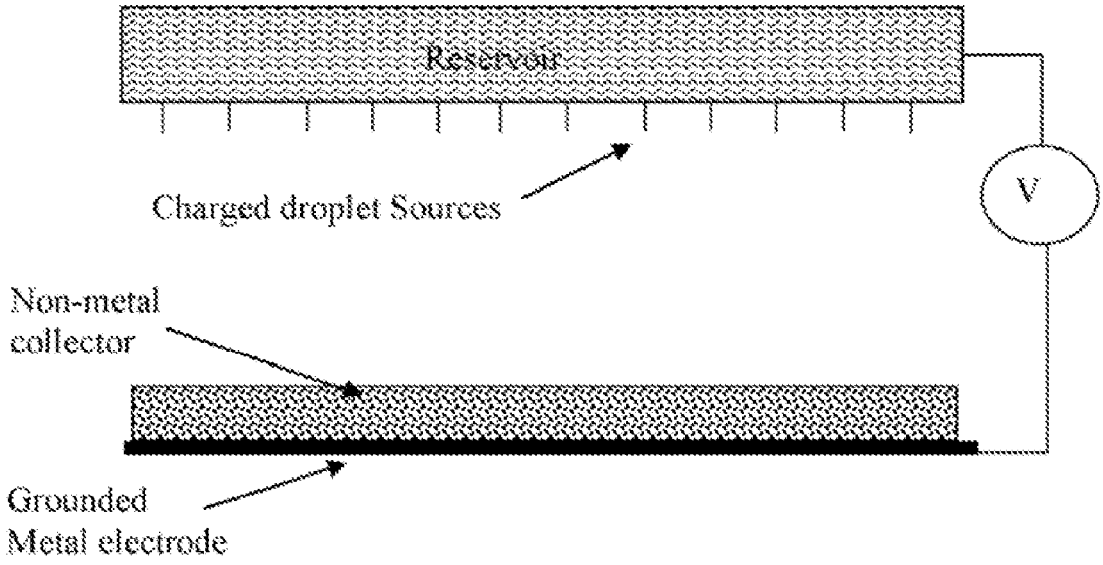
FIG. 4 is a schematic diagram of electrode geometry including the non-metal collector of an embodiment.

In some of the embodiments of the claimed subject matter, a non-metal collector is placed on top of the grounded metal electrode as shown in FIG. 4. This non-metal collector may consist of a high surface area material such as a mesh of fine fabrics or it could be a replaceable filter that would be removed and replaced periodically. The non metal collector may also be constructed of a chemically reactive material that would react with collected molecules. For example, this embodiment may be used for the removal of odors and other air contaminants with a high vapor pressure since high vapor pressure molecules tend to leave the metal collector and instead evaporate returning to the gas phase.

One common example of a chemically reactive collector material is activated carbon, which is routinely used in various air purification devices to remove chemical contaminants. However, in the existing devices, the air stream must be forced through the activated carbon, which imparts a significant pressure drop and introduces noise and additional operational problems. A distinct advantage of the aforementioned Sentor embodiments is that the collector does not interfere with the air stream, which normally flows above the surface of the collector. The charged contaminants are driven into the collector by the electric field.

One potential problem that can occur when using a non-metal collector is charge accumulation. If the collector material does not have sufficient electrical conductivity to transport the electrical charge through to the grounded metal backing electrode thereby completing the circuit, charge will accumulate within the non-metal collector and the presence of this trapped charge will ultimately prevent the subsequent deposition of additional charged contaminants with the same charge polarity. This charge accumulation can significantly reduce the collection efficiency of the device.

Figure 5:
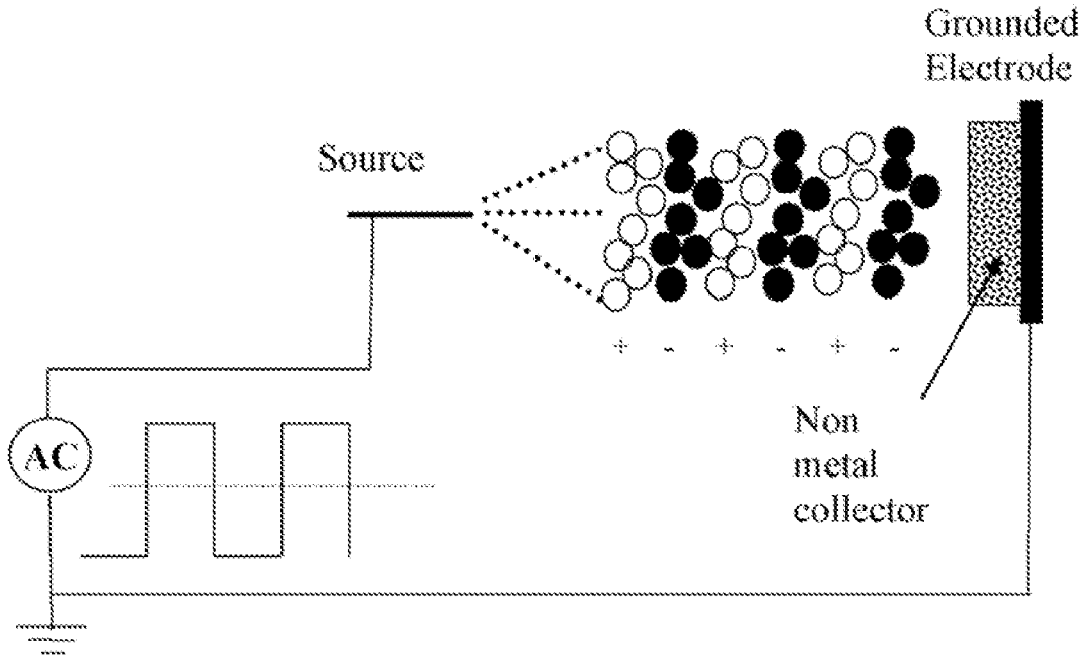
FIG. 5 is a schematic diagram illustrating an embodiment having an AC electrospray source with alternating streams of charged liquid droplets.

One solution to this problem is by using AC driving potentials instead of the traditional DC potentials. When using AC fields, the polarity of the electrically charged liquid droplets switches from positive to negative at a frequency determined by the frequency of the driving potential. In one embodiment, an alternating stream of positive and negative charged droplets are emitted from a charged droplet generator, in this embodiment a parallel array of charged droplet generator electrospray sources. This process is illustrated schematically in FIG. 5.

The frequency of the AC potential can be 60 Hz, for example, but other frequencies are possible ranging from very low frequencies (e.g. 10 Hz) to very high frequencies (e.g. kHz). The waveform of the AC potential can be a square wave as illustrated in FIG. 4 or it could be a sinusoidal wave, a saw tooth or other alternating potential. The magnitude of the waveform during each half cycle can produce an electric field at droplet generator capable of forming and sustaining an electrospray process. The alternating stream of positively and negatively charged liquid droplets will neutralize each other on the non metal collector, thus preventing charge accumulation even on collecting materials such as polymer fabrics exhibiting very low electrical conductivity.

One advantage of the AC potential is that the surface of the collecting electrode does not need to be electrically conducting. In DC mode this electrode must be conducting to prevent charge accumulation. In AC mode the positive and negative charges cancel each other on the surface such that any collecting substrate material can be used—even highly insulating substrates such as a cloth fabric or filter or a sheet of glass.

For example, AC fields enable the use of disposable, high surface area filters placed on top of the grounded metal electrode. In DC mode, such filters would charge up and the air purification efficiency would decrease dramatically. The AC potential could be a square wave, sine wave, saw tooth for example. The amplitude of the positive and negative half cycles in the AC waveform should be sufficiently high to produce an electric field at the electrospray source which can overcome the surface tension of the liquid (e.g. water) and produce an electrospray. An example of ranges is + or −2-4 kV/cm. The frequency can range from very low (a few Hz) to on the order of 1000 Hz.

Another advantage of the AC potential is that it may reduce the cost of construction of the high voltage power supply. For example, it is possible to directly up-convert 60 Hz line voltage into a high voltage waveform with very little circuitry, essentially using a single transformer. Another advantage of the AC potential is that is automatically provides good collection efficiency to charged air contaminants of either polarity, while the DC potential would give preferential affinity to those contaminants that have a charge opposite to the polarity of the DC potential. For example, combustion products are often not neutral, but charged and can have either positive or negative polarity.

The embodiments described above illustrate various methods, systems and apparatuses that may be implemented according to the claimed subject matter. It is not intended, however, that the claimed subject matter be limited to the above-described embodiments.

What is claimed is:

1. An improved contaminant extraction system for extracting contaminants from an air flow comprising:

a first channel with an inlet and an outlet into which a first air flow is directed, said first air flow containing a plurality of contaminants;

a solvent reservoir containing a volume of solvent;

one or more electrospray sources for producing a plurality of charged liquid droplets;

a second channel with an inlet and an outlet into which a second air flow is directed;

one or more voltage reduction electrodes positioned about at least one of said electrospray sources;

a grounded counter electrode; and at least one grid positioned between the plane of said electrospray source and said grounded counter electrode, wherein the voltage between the grid and said charged droplet source is sufficient to sustain an electrospray process and the electrostatic force at said one or more electrospray sources is sufficient to overcome the surface tension of the solvent;

wherein the electrospray droplets are dispersed into said first channel allowing said plurality of contaminants in said first air flow to become charged;

wherein the maximum air velocity in the first channel is below the velocity at which charged contaminants would be carried through the air purification system without being transported through said grid and into said second air stream;

and wherein said grid extracts the charged contaminants from said first air flow after which the charged contaminants are transferred into said second air flow.

2. The improved contaminant extraction system of claim 1 wherein said second air flow is made up of more than one air flow.

3. The improved contaminant extraction system of claim 1 wherein the distance between the electrospray sources and the grid is large enough to provide an airflow channel.

4. The improved contaminant extraction system of claim 1 wherein said voltage between said grid and said electrospray source plane is maintained in a range of about 2 to about 4 kV/cm.

5. The improved contaminant extraction system of claim 1 wherein the maximum air velocity in the first channel is below the velocity at which said charged contaminants are carried through said contaminant extraction system without being transported through said grid and into the second air stream.

6. The improved contaminant extraction system of claim 1 wherein the distance between the charged droplet sources and said grid is small so that the electric field magnitude rather than the voltage magnitude initiates and sustains an electrospray process thereby reducing the source-to-grid distance and the source to grid voltage requirements.

7. The improved contaminant extraction system of claim 1 wherein said voltage reduction electrode and tips of said the electrospray source are arranged in a non specific geometric correlation.

8. The improved contaminant extraction system of claim 1 wherein said voltage reduction electrode is a cylinder coaxial with a central cylinder containing the electrospray sources which protrude radially from the center cylinder and wherein a grounded third electrode is coaxial to the two inner cylinders.

9. The improved contaminant extraction system of claim 1 wherein said electrospray source is one or more wick-based electrospray sources.

10. The improved contaminant extraction system of claim 1 wherein said electrospray source is one or more capillary tubes.

11. The improved contaminant extraction system of claim 1 wherein said solvent is a water and/or water plus alcohol based solution.

12. The improved contaminant extraction system of claim 11 wherein said solvent further includes an anti-bacterial compound.

13. The improved contaminant extraction system of claim 1 wherein said grid also functions to isolate the electrospray sources from the main airflow channel thereby protecting them from dust and contamination and aiding in extending the useful lifetime of the system between cleanings.

14. The improved contaminant extraction system of claim 1 wherein said grid is substantially constructed of an electrically conductive material.

15. The improved contaminant extraction system of claim 1 farther comprising a support frame for supporting said grid.

16. The improved contaminant extraction system of claim 1 wherein said grid is heated.

17. An improved contaminant extraction system for extracting contaminants from an air flow, comprising:

a first channel with an inlet and an outlet into which a first air flow is directed, said first air flow containing a plurality of contaminants;

a solvent reservoir containing a volume of solvent;

an electrospray generator for using said solvent to produce a plurality of charged liquid droplets in said first channel;

a second channel with an inlet and an outlet into which a second air flow is directed;

an electric field generator for generating a first electric field in said first channel and for generating a second electric field in said second channel, wherein the second electric field is of a magnitude greater than the first electric field;

a grid located between said first channel and said second channel; and a non-metal collector positioned above said grid;

wherein said charged liquid droplets are dispersed into said first channel allowing said plurality of contaminants in said first air flow to become charged;

and wherein said charged containments are expelled into said second air flow using the potential difference generated from the second electric field;

and wherein said second air flow containing said charged contaminants is expelled out of the second channel outlet and a purified air flow is expelled from the outlet of said first channel.

18. The improved contaminant extraction system of claim 17 wherein said non metal collector is constructed of a chemically reactive material that would react with collected molecules.

19. The improved contaminant extraction system of claim 18 wherein said non metal collector is constructed of activated carbon.

20. The improved contaminant extraction system of claim 17 wherein an alternating stream of positive and negative charged droplets are emitted from the electrospray generator.

* * * * *